US006435665B2

(12) United States Patent
Lerat et al.

(10) Patent No.: US 6,435,665 B2
(45) Date of Patent: Aug. 20, 2002

(54) DEVICE FOR CONTROLLING FLUID MOVEMENT

(75) Inventors: Yannick J. Lerat; Olivier J. Poncelet, both of Chalon sur Saone; Thierry G. Vachette, Esbarres, all of (FR)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 09/907,976

(22) Filed: Jul. 18, 2001

Related U.S. Application Data

(63) Continuation-in-part of application No. 09/327,237, filed on Jun. 7, 1999.

(30) Foreign Application Priority Data

Jun. 12, 1998 (FR) ..... 98 07600

(51) Int. Cl.[7] ..... B41J 2/04
(52) U.S. Cl. ..... 347/54; 347/47; 347/45
(58) Field of Search ..... 347/54, 47, 45; 417/207, 48, 54

(56) References Cited

U.S. PATENT DOCUMENTS

| | | | | |
|---|---|---|---|---|
| 5,278,126 A | | 1/1994 | Katano et al. | |
| 5,612,725 A | * | 3/1997 | Okimoto | 347/71 |
| 6,190,003 B1 | * | 2/2001 | Sato et al. | 347/54 |

FOREIGN PATENT DOCUMENTS

| | | |
|---|---|---|
| EP | 0787588 | 8/1997 |
| JP | 08 230232 | 9/1996 |

* cited by examiner

*Primary Examiner*—John Barlow
*Assistant Examiner*—M S Shah
(74) *Attorney, Agent, or Firm*—David A. Novais

(57) ABSTRACT

The present invention relates to a device for controlling fluid movements. The device includes a fluid guiding device, and a fluid moving device which includes polymers whose hydrophilic and hydrophobic properties can be selected under the action of an external force. The fluid moving device comprises a plurality of polymer elements whose hydrophilic and hydrophobic properties can be selected. The elements are arranged along the guiding device and at least one actuating unit is used to generate the external force.

16 Claims, 4 Drawing Sheets

DEVICE FOR CONTROLLING FLUID MOVEMENT

CROSS-REFERENCE TO RELATED APPLICATION

This is a continuation-in-part of application Ser. No. 09/327,237 filed Jun. 7, 1999, titled DEVICE FOR CONTROLLING FLUID MOVEMENT by Yannick Lerat, Olivier Poncelet and Thierry Vachette.

FIELD OF THE INVENTION

The present invention relates to a device for controlling fluid movements, especially a device capable of being used in ink jet printers.

BACKGROUND OF THE INVENTION

In the field of ink jet printing, it is important to control the quantity of ink to be ejected in order to obtain optimum print quality. In the case of color printing, the print quality also depends on the color rendition obtained. Generally, ink jet color printers have reservoirs with each containing ink with a defined color, and each color of ink is ejected through a nozzle in the ink jet head. Usually, the inks used are inks with the colors yellow, magenta, cyan and black. The printing of a series of dots of yellow, magenta, cyan and black ink is controlled by a dithering technique that enables the different colored dots to be arranged so as to represent any color. U.S. Pat. No. 5,612,725 as an example, discloses a method for recording characters on a recording medium with specific recording heads, wherein devices including piezoelectric elements that generate a change of pressure allow the ink to be jetted out of nozzles in ink drops. The invention disclosed in U.S. Pat. No. 5,612,725 is an ink-jet recording head whose nozzles and ink flow channels can readily be formed and thus mass produced and which uses inexpensive glass and plastic plates. Components of the ink-jet recording head are collected together by a thermal fusion bonding method which improves the quality of the assembly. Moreover, the inner faces of the through-hole and the intermediate nozzle are made hydrophilic, whereas the inner and open faces of the terminal nozzle are made water-repellent or hydrophobic. The state of faces of the components are permanently either hydrophilic or hydrophobic; while the state of a given element cannot be changed from hydrophilic to hydrophobic or vice-versa. The problem with such a printing technique is that the print dots are visible.

SUMMARY OF THE INVENTION

An object of the present invention is to provide for a device that enables the movement of fluids to be controlled with accuracy, in particular to move fluid quantities defined with precision.

A further object of the present invention is to provide for a device that enables the control of several fluids in order to obtain mixtures of these fluids defined with precision.

The invention relates to a device for controlling fluid movements that comprises:

a) a fluid guiding element for guiding fluids;

b) at least one fluid moving element for moving fluids, with the at least one fluid moving element comprising polymers having hydrophilic and hydrophobic properties corresponding to two different hydrophilic or hydrophobic states of the polymers, and the properties being selected under an action of an external force; and c) at least one actuating unit which generates the external force, with the at least one fluid moving element comprising a plurality of polymer elements whose hydrophilic and hydrophobic properties are selected. The polymer elements are arranged along the fluid guiding element and the polymer elements are actuated in succession to switch from the hydrophilic state to the hydrophobic state or vice-versa, in order to gradually move a quantity of fluid along the fluid guiding element.

The present invention also relates to a device for controlling fluid movement that comprises at least one channel which guides fluid; a plurality of polymer elements arranged along the at least one channel, with the plurality of polymer elements having hydrophilic and hydrophobic properties and being switchable between hydrophilic and hydrophobic states upon an action of an external force; and at least one actuating unit which provides the external force to change a state of the polymer element and cause a movement of the fluid in the at least one channel.

The present invention also relates to a method of moving fluid which comprises the steps of: supplying fluid to at least one guide channel, with the at least one guide channel having a plurality of polymer elements arranged there along, and the plurality of polymer elements having hydrophilic and hydrophobic properties and being switchable between hydrophilic and hydrophobic states; and moving the fluid in the at least one channel by applying an external force to at least one of the polymer elements to change a state of the at least one of the polymer elements.

The present invention further relates to a device for controlling fluid movement which comprises: a plurality of polymer elements arranged on a flat surface, with the plurality of polymer elements having hydrophilic and hydrophobic properties and being switchable between hydrophilic and hydrophobic states upon an action of an external force; and at least one actuating unit which provides the external force to change a state of the polymer element and cause a movement of the fluid on the flat surface.

The present invention also relates to a method of moving fluid which comprises the steps of: supplying fluid to a flat surface, with the flat surface having a plurality of polymer elements arranged thereon, and the plurality of polymer elements having hydrophilic and hydrophobic properties and being switchable between hydrophilic and hydrophobic states; and moving the fluid on the flat surface by applying an external force to at least one of the polymer elements to change a state of the at least one of the polymer elements.

BRIEF DESCRIPTION OF THE DRAWINGS

Other characteristics will appear on reading the following description, with reference to the drawings wherein.

DETAILED DESCRIPTION OF THE INVENTION

In general, the technique used to move fluids according to the invention includes using a polymer element whose hydrophilic and hydrophobic properties can be selected under the action of an external force. The principle of this technique is described in U.S. application Ser. No. 09/249,459, filed Feb. 12, 1999 and entitled "Device for Moving a Fluid" in the name of Yannick J. Lerat et al. The external force required to switch from one state to the other and thus also the means to generate the external force are determined according to the choice of the polymer.

Figure 1A:
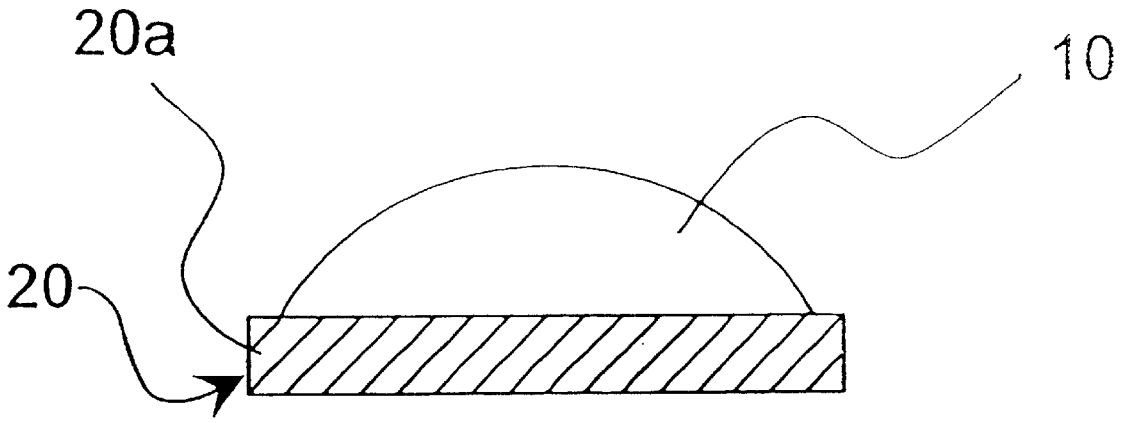
FIG. 1A represents a polymer element in a hydrophilic state on which there is a drop of hydrophilic fluid.
Figure 1B:
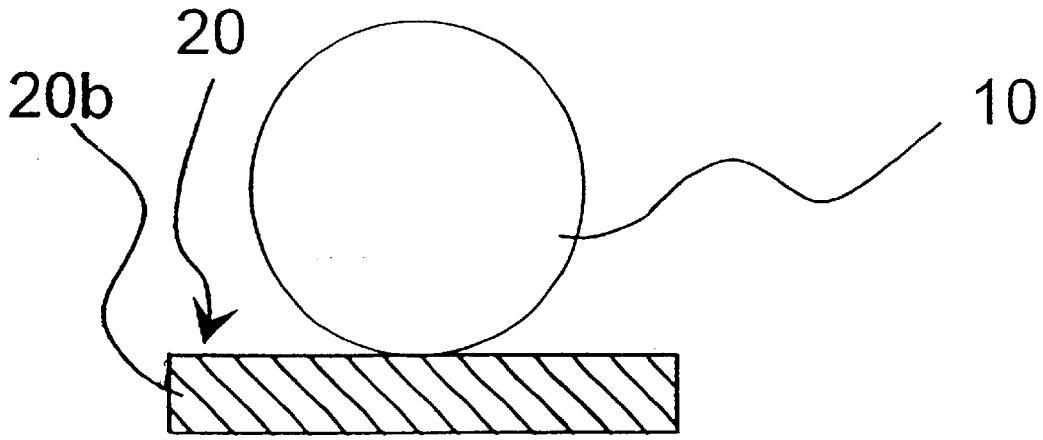
FIG. 1B represents a polymer element in a hydrophobic state on which there is a drop of hydrophilic fluid.

Thermo-reversible polymers comprise surfaces which are sensitive to the temperature and the polymers are prepared by grafting layers of PNIPAAm poly (N-isopropylacrylamide) hydrogel on the surface of silicone wafers. Several known techniques by those skilled in the art are developed to graft PNIPAAm on the surfaces. For example, the PNIPAAm layer can be immobilized on the surfaces of substrates by chemical (described in the publication Macromolecules 1994, Takei Y. G.) and physical grafting. By introducing for example PNIPAAm claims with freely mobiles ends, the surface properties are altered within a narrow temperature range, and the surface responds to the temperature changes rapidly. These polymers are changing their properties when a change occurs in environmental stimuli, for example temperature. Thus, under the action of a stimulus element the state of aqueous solutions of PNIPAAm changes from hydrophobic to hydrophilic, and inversely, in a fast and reversible manner around the lower critical solution temperature (LCST) of about 32° C. LCST is also called the phase transition temperature Tg of the polymer. PNIPAAm chains have an expanded conformation in water below the LCST due to the strong hydration and change to compact forms above the LCST by sudden dehydration. Practically the reversible hydrophilic or hydrophobic properties of the surface of polymers are determined by the dynamic contact angle. The grafting operation is arranged to create a cross-linked PNIPAAm layer on the surface of the silicone wafer. The effect of the temperature on the surface properties modified by a cross-linked PNIPAAm layer is evaluated by aqueous dynamic contact angle measurements. The cross-linked PNIPAAm layer swells by imbibing water, below the LCST, and water spreads on the surface of the substrate; subsequently, the contact angle of the surface is lower (FIG. 1A). The cross-linked PNIPAAm layer shrinks and becomes more hydrophobic, above the LCST; the water cannot spread on the surface and the surface exhibits a higher contact angle (FIG. 1B). Thus, the morphology of the surface modified by a cross-linked PNIPAAm layer leads to a completely hydrophilic surface with a contact angle equal to zero degree below 25° C. (FIG. 1A) and a contact angle of more than 90 degrees above 40° C. when the surface becomes extremely hydrophobic (FIG. 1B).

The polymer element 20 can be in a hydrophilic state 20*a* or in a hydrophobic state 20*b*. The principle is to have an element 20 composed of such polymers in contact with the fluid 10 that is to be moved. When the polymer element 20 is in its hydrophilic state 20*a*, as represented in FIG. 1A, the fluid 10 tends to stay in contact with the polymer element 20. However, when the polymer element 20 is switched to its hydrophobic state 20*b*, as represented in FIG. 1B, the fluid 10 tends to be repelled and therefore to form a drop on the surface of the polymer element 20. Thus, the switching of the polymer element 20 from one state to the other causes movement of the fluid 10.

When thermo-reversible polymers are selected, that is polymers which, when their temperature exceeds a threshold temperature called the phase transition temperature, switch from a hydrophilic state to a hydrophobic state or vice-versa, the external force will be the application of thermal energy. Preferably thermo-reversible polymers should be selected that have a phase transition temperature between 20° C. and 100° C., and preferably between 30° C. and 70° C. The thermo-reversible polymers, which are used in the present device, are organic polymers such as those described in Patent Application WO 91/15526. These are polymers that have a hydrophilic group and a hydrophobic group, the hydrophilic group being a water-soluble ionic polymerizable vinyl monomer, and the hydrophobic group comprising an acrylamide or methacrylamide monomer. For example a poly(N-alkylacrylamide), a modified glycol polyethylene or a polysilylamine is selected. Preferably a polymer is used that switches from one state to the other very quickly, for example poly(N-isopropylacrylamide). To make the polymer element switch from its hydrophilic state to its hydrophobic state, it has to exceed a hydrophilic/hydrophobic phase transition temperature Tg proper to the polymer. Poly(N-isopropylacrylamide) has a Tg temperature of about 32° C. When the polymer is at a temperature less than 32° C., it is hydrophilic. When it is higher than 32° C., it becomes hydrophobic. In addition, the hydrophilic/hydrophobic phase transition temperature of a polymer can be modified by different means. For example adding a surfactant to the fluid to be moved can increase the phase transition temperature. This technique is described in the publication, Langmuir, 1995, Volume 11, No. 7, pages 2493–2495. For example, the phase transition temperature Tg of poly(N-isopropylacrylamide) can be modified from 32° C. to 90° C.

Means to generate the external force, in this case thermal energy, are for example constituted by a temperature control element, for example a heating element arranged in contact with the polymer element. The heating element is, for example, constituted by a thin film of polycrystalline silicon in which a current is passed that is adapted to generate an amount of thermal energy to allow the polymer to exceed its phase transition temperature and to switch from one state to the other. The polymer element can then return to its initial state, its temperature having decreased by simple heat diffusion. An additional cooling system can also be provided such as for example a radiator or a Pelletier effect device.

Electrically conductive organic polymers can be selected, for example, polymethylethiophene, which, under the action of an electric current as an external force, switch from the hydrophilic state to the hydrophobic state or vice-versa. Elements to generate the external force in this case are those for applying an electric current to the polymer element.

Depending on the polymer selected, other external forces can be used such as for example, a pH change, a change of ionic strength, or a pressure. For each polymer, the means appropriate for generating the force will be determined by those skilled in the art who know the force necessary to switch the polymer from the hydrophilic state to the hydrophobic state. Surfaces of the polymer have an improved sensitivity to temperature changes in increasing the cross-linking density of the polymer layer and varying the polymerization time. Subsequently, in a capillary tube or channel whose internal wall is coated by a cross-linked PNIPAAm layer, an aqueous solution is expelled from the channel if the polymer is in hydrophobic state. For example, the difference in the water heights reaches 10 mm in a channel with a diameter of 2 mm with a change in temperature from 25 to 50° C.

For the relevant polymers, it is known that the hydrophilic/hydrophobic state change causes the polymer volume to vary. However, in certain embodiments that will be described, it is preferable to deal with these volume variations. Also, it is known how to control the volume variations of polymers that can switch from a hydrophilic to a hydrophobic state. Therefore, known techniques such as those described in Polymer Communications, 1991, volume 32, pages 322–323, "Synthesis of fast response, temperature-sensitive poly(N-isopropylacrylamide) gel", can be used.

All the embodiments that are to be described below are used to control the movement of hydrophilic fluids. However, when the fluid whose movement is to be controlled is hydrophobic, the embodiments described below are used with appropriate polymers.

Figure 2:
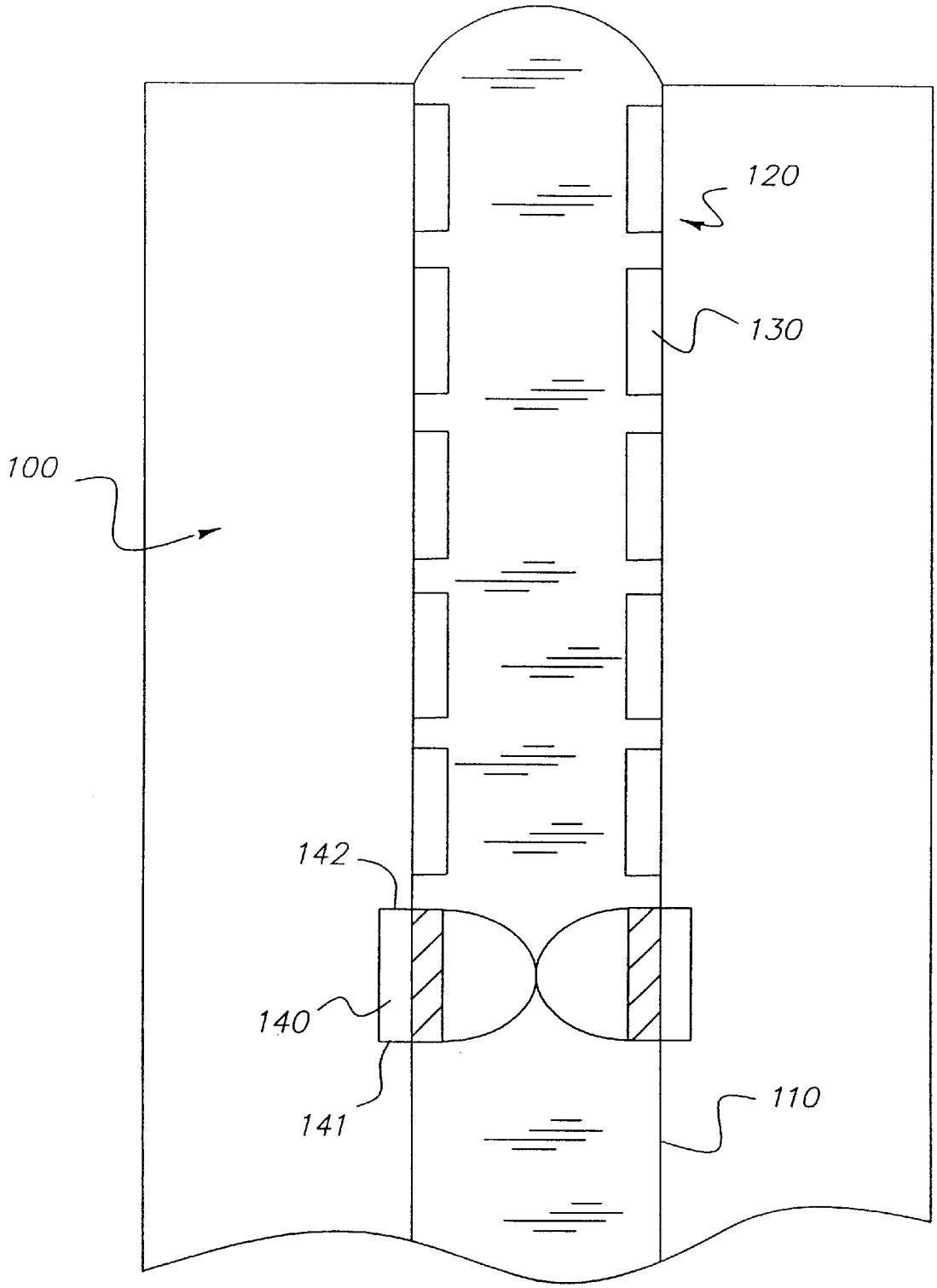
FIG. 2 represents a first embodiment of the invention.

Referring now to FIG. 2, a first embodiment of the device according to the invention will be described. The device for controlling fluid movement according to the invention comprises a fluid guiding element 100 which comprises a channel 110 in which the fluid flows. In order to move the fluid in the channel 110, movement elements 120 are provided on an internal wall of channel 110. Movement elements 120 comprise a plurality of polymer elements 130 whose hydrophilic and hydrophobic properties are selected under the action of an external force. Elements 130 are arranged along channel 110. An external force is applied to polymer elements 130 by means of an actuating unit 140. Actuating unit 140 is, for example, a heating element. This heating element is arranged in contact with a polymer element 130, preferably, the polymer element 130 located in channel 110, which the fluid first contacts when moving. This heating element 140 works, for example, by generating a heating or a rise in temperature, from the base 141 of the heating element toward the top 142 of the heating element. In another embodiment, the heating element works according to an on-off mode; i.e., the temperature is raised in the whole heating element in an homogenous way. In this embodiment, polymer elements 130 are used that are hydrophobic when their temperature is less than their phase transition temperature. When the fluid reaches the channel 110 by whatever means, polymer elements 130 are in a hydrophilic state. The fluid can thus fill channel 110. A thermal force is then applied to the polymer element on which the heating element is arranged. This element becomes hydrophobic which causes the fluid to move. The thermal force propagates by thermal diffusion and is gradually transmitted to the polymer elements 130 that are arranged in succession in channel 110 in the direction of the fluid movement. Additional actuating units 140 can further be provided for each polymer element 130. The quantity of fluid to move is then determined according to which polymer element 130 is actuated first.

Figure 3:
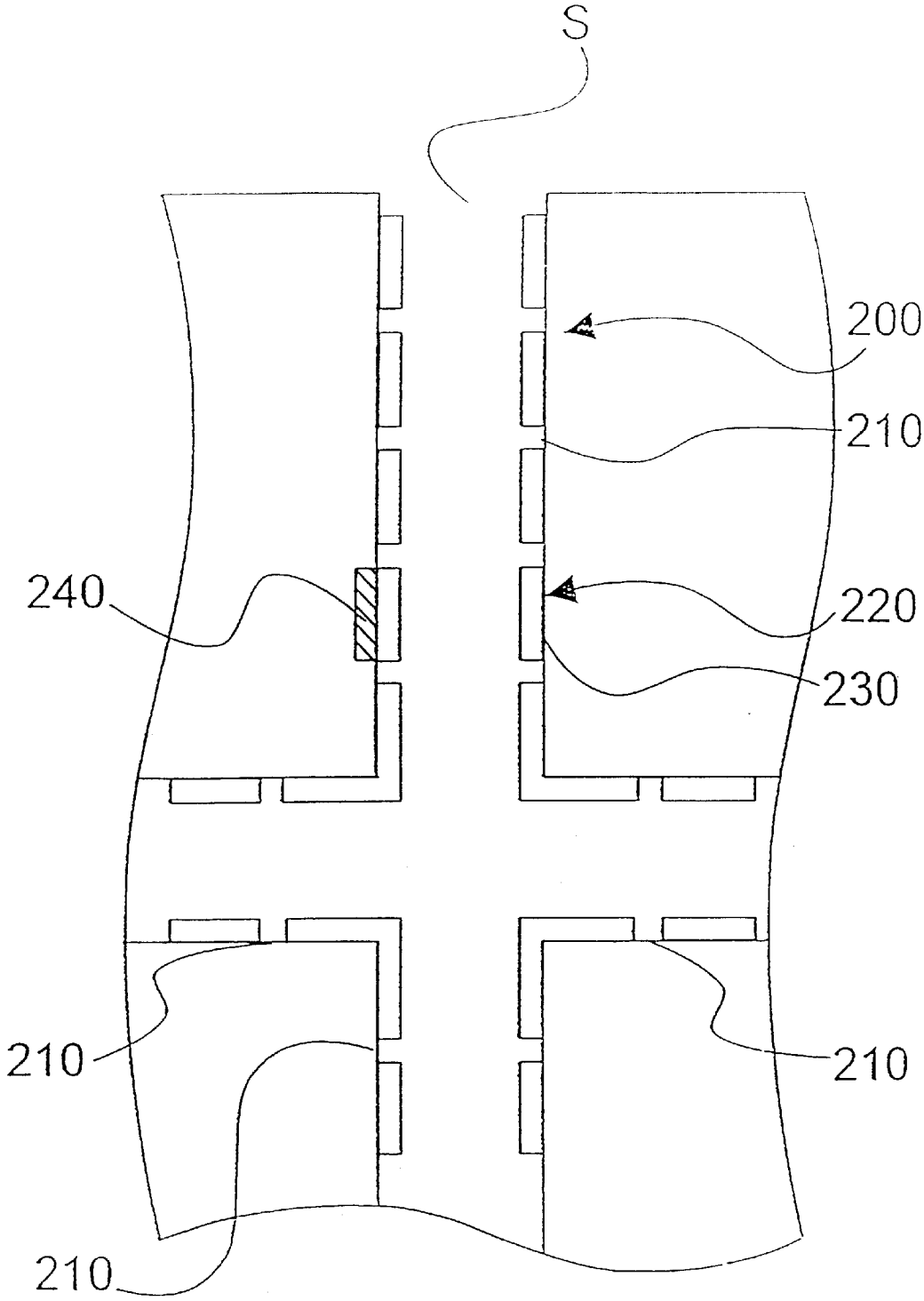
FIG. 3 represents a second embodiment of the invention.

A second embodiment of the device for controlling fluid movement is shown in FIG. 3. A guiding element 200 comprises several channels 210 similar to channels 110 described above, which are made in a matrix and converge. Channels 210, for example, are each connected to a reservoir of different fluids that is not shown and converge towards a single channel linked to an outlet S of the device. This embodiment for example is useful for ink jet heads. Thus three channels 210 can be planned connected respectively to three ink reservoirs, each reservoir containing one ink color, yellow, magenta and cyan respectively. The three channels converge to one channel terminated with an injection nozzle of the ink jet head. The actuation of the various polymer elements 230 present in each channel 210 through an actuation unit 240 (only one is shown) allows the quantity of ink to be moved in a channel to be controlled. A nozzle can eject a perfectly defined mixture of the three ink colors, yellow, magenta and cyan. A fourth channel can also be provided connected to a fourth reservoir containing black ink.

In one alternative of the first and second embodiments that is not shown, polymer elements 130, 230 are constituted of a continuous polymer film provided for the length of the channels.

In another alternative of the first and second embodiments that is not shown, the channels can be arranged on the surface of a matrix. They are then obtained for example by engraving.

Figure 4:
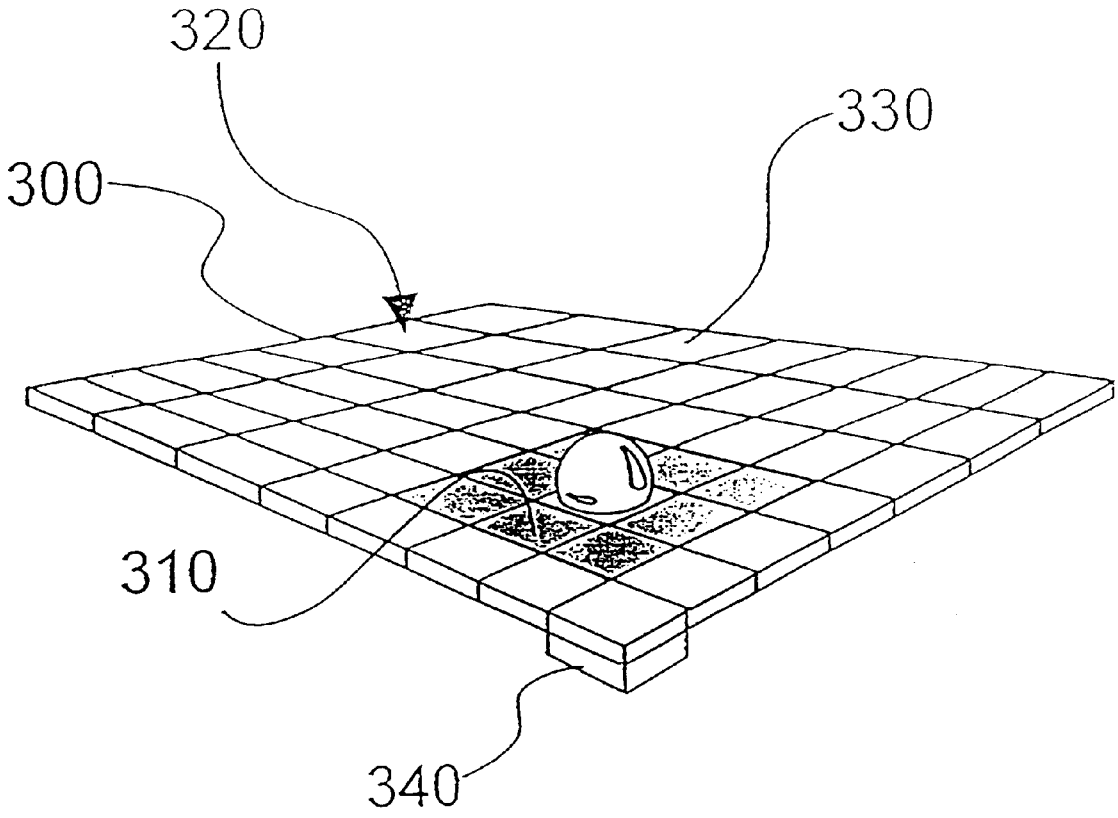
FIG. 4 represents a third embodiment of the invention.

FIG. 4 represents a third embodiment of the device to control fluid movement. The device of FIG. 4 comprises movement elements 320 arranged on a flat surface. Movement elements 320 are constituted by a plurality of polymer elements 330 whose hydrophilic and hydrophobic properties are selected under the action of an external force. Polymer elements 330 are juxtaposed so as to form a continuous polymer surface. An actuating unit 340 (only one is shown) is provided under the surface of a polymer element 330 to generate the external force. The actuating unit includes many independent heating elements arranged contiguously. A "mosaic type" surface of heating elements is thus obtained. Such an embodiment of the invention is obtained by juxtaposing the heating elements, for example resistors, and by covering them with the polymer film whose hydrophilic and hydrophobic properties are selected under the action of an external force. The heating elements can be actuated independently and in succession.

A fluid guiding element 300 then comprises fluid moving elements 320, that is, the elements of the polymer surface according to their state. The liquid moves on the flat surface through the successive actuation of part of the polymer surface. If polymer elements 330 are used that are hydrophilic when their temperature is less than their phase transition temperature, when, for example, there is a hydrophilic fluid on an element of the polymer surface whose corresponding heating element is not actuated; the corresponding heating element of the polymer surface where the fluid is found is actuated so as to make it hydrophobic in order to move it and guide it on a precise path, with the fluid having a tendency to be pushed away from the surface. At the same time, a closely situated heating element must then stay inactive so that the fluid moves onto the surface of the polymers corresponding to this heating element. The other heating elements situated close to the last element are actuated so that the elements of the corresponding polymer surface are hydrophobic. Thus, the fluid is guided by the elements of the polymer surface that constitute guiding elements 300. If polymer elements 330 are used that are hydrophobic when their temperature is less than their phase transition temperature, successive elements of the contiguous surface are actuated where it is wanted to move the fluid.

This embodiment is especially useful in ink jet heads. For example three reservoirs can be provided, each reservoir containing one ink color, yellow, magenta and cyan. A channel enables the ink to be taken from each reservoir to the device for controlling the fluids. The different inks can be guided so as to converge on a selected surface in order to obtain a mixture of ink, with this mixture then being guided to the inlet of a channel terminated by an injection nozzle of an ink jet head.

In the embodiments of the invention that have just been described and that can be used in ink jet heads, the device can be planned to control the movement of a compound to be added to the ink to be ejected, just before ejection. Such a device can be used to add a solvent to the ink in order to obtain an ink drop of a constant volume to be ejected, or even a surfactant in order to modify the surface energy of the ink drop to be ejected. It is further possible to add a bleaching agent to modify the density of the ink color, or even a catalyst enabling accelerated polymerization of the ink on ejection.

The printing obtained using the device of the present invention is practically continuous, and with the different colors represented can be obtained without using a dithering technique.

Clearly the invention as claimed can be used to control the movement of fluids other than inks. For example it can be used in the medical field for dosing medicines.

The invention has been described in detail with particular reference to certain preferred embodiments thereof, but it will be understood that variations and modifications can be effected within the spirit and scope of the invention.

What is claimed is:

1. A device for controlling fluid movement comprising:

a) a fluid guiding element for guiding fluids supplied in said fluid guiding element;

b) at least one movement element for moving fluids, said movement element comprising at least one thermo-reversible polymer element having hydrophilic and hydrophobic properties corresponding to two different switchable hydrophilic and hydrophobic states of said thermo-reversible polymer element, said properties being selected under an action of an external thermal energy; and c) at least one actuating unit comprising a heating element and in contact with said thermo-reversible polymer element, which generates said external thermal energy, said thermo-reversible polymer element being arranged along said fluid guiding element and the properties of said thermo-reversible polymer element being selected to switch said thermo-reversible polymer element from the hydrophilic state to the hydrophobic state or vice-versa, in order to gradually move a quantity of fluid along said fluid guiding element.

2. A device according to claim 1, wherein said fluid guiding element comprises at least one channel.

3. A device according to claim 1, wherein said fluid guiding element comprises a plurality of conveying channels which are made in a matrix and converge.

4. A device according to claim 2, wherein said at least one fluid movement element is arranged on an internal wall of said channel of said fluid guiding element.

5. A device according to claim 1, wherein said fluid guiding element is provided on a flat surface.

6. A device according to claim 5, wherein said fluid guiding element comprises fluid movement elements on the flat surface.

7. A device according to claim 1, wherein said at least one actuating unit comprises at least a temperature controlling element.

8. A device according to claim 7, wherein said temperature controlling element comprises a resistor in contact with said thermo-reversible polymer element, said resistor being supplied by an electric circuit.

9. A device according to claim 1, wherein said thermo-reversible polymer element whose hydrophilic and hydrophobic properties are selected under the action of said external thermal energy is an electrically conducting organic polymer.

10. A device according to claim 9, wherein said actuating unit comprises an element for applying an electric current.

11. A device according to claim 1, wherein said device is used in a printing fluid jet head.

12. A device head according to claim 1, wherein the fluid is ink.

13. A device for controlling fluid movement comprising:

a) a fluid guiding element for guiding fluids;

b) at least one fluid moving element for moving fluids, said at least one fluid moving element comprising polymers having hydrophilic and hydrophobic properties corresponding to two different hydrophilic or hydrophobic states of said polymers, said properties being selected under an action of an external force; and c) at least one actuating unit which generates said external force, said at least one fluid moving element comprising a plurality of polymer elements whose hydrophilic and hydrophobic properties are selected, said polymer elements being arranged along said fluid guiding element and said polymer elements being actuated in succession to switch from the hydrophilic state to the hydrophobic state or vice-versa, in order to gradually move a quantity of fluid along said fluid guiding element; and wherein said polymer whose hydrophilic and hydrophobic properties are selected under the action of an external force is a thermo-reversible polymer.

14. A method of moving fluid comprising the steps of:

a) supplying fluid to at least one guide channel, said at least one guide channel comprising at least one thermo-reversible polymer element arranged there along, said therimo-reversible polymer element having hydrophilic and hydrophobic properties and being switchable between hydrophilic and hydrophobic states of said polymer element; and b) moving said fluid in said at least one channel by applying an external thermal energy to at least one of said thermo-reversible polymer elements to change a state of said at least one polymer element.

15. A device for controlling fluid movement, the device comprising:

a plurality of polymer elements arranged on a flat surface, said plurality of polymer elements having hydrophilic and hydrophobic properties and being switchable between hydrophilic and hydrophobic states upon an action of an external force; and at least one actuating unit which provides said external force to change a state of said polymer element and cause a movement of said fluid on said flat surface.

16. A method of moving fluid comprising the steps of:

supplying fluid to a flat surface, said flat surface having a plurality of polymer elements arranged thereon, said plurality of polymer elements having hydrophilic and hydrophobic properties and being switchable between hydrophilic and hydrophobic states; and moving said fluid on said flat surface by applying an external force to at least one of said polymer elements to change a state of said at least one of said polymer elements.

* * * * *